United States Patent [19]

Marsin

[11] 4,171,812

[45] Oct. 23, 1979

[54] MECHANICAL GOLF GREEN

[76] Inventor: Daniel J. Marsin, Box 4535 New River Stage, Phoenix, Ariz. 85029

[21] Appl. No.: 916,706

[22] Filed: Jun. 19, 1978

[51] Int. Cl.[2] ..... A63B 69/36

[52] U.S. Cl. ..... 273/185 R; 273/182 R; 273/181 D

[58] Field of Search ..... 273/184 R, 185 R, 105 A, 273/182 R, 180, 179 C, 181 D

[56] References Cited

U.S. PATENT DOCUMENTS

| | | | |
|---|---|---|---|
| 1,442,054 | 1/1923 | Dixon | 273/105 A X |
| 1,923,152 | 8/1933 | Kohn | 273/105 A X |
| 2,164,808 | 7/1939 | Everett | 273/179 C |
| 2,301,767 | 11/1942 | Willingham | 273/105 A |
| 3,350,099 | 10/1967 | Smart | 273/184 R X |

FOREIGN PATENT DOCUMENTS

| | | | |
|---|---|---|---|
| 464765 | 5/1950 | Canada | 273/105 A |

*Primary Examiner*—George J. Marlo
*Attorney, Agent, or Firm*—Don J. Flickinger

[57] ABSTRACT

A mechanical golf green designed primarily for installation in a waste area such as a desert and on a mound of sand or comparable material. The mechanism comprises a central cylindrical cup and two annular compartments concentric with the cup. The cup and each of the annular compartments is formed with an inverted conical bottom terminating in a discharge opening. A return conduit is provided for each of these openings and has one end connected to the conical bottom and the other end to a sectional return receptacle which includes indicia for each section identifying the source from which a golf ball is returned.

7 Claims, 7 Drawing Figures

MECHANICAL GOLF GREEN

The present invention relates to a mechanical golf green and is concerned primarily with a device which is particularly adapted for installation in a mound that is formed on a wasteland setting such as a desert.

BACKGROUND OF THE INVENTION

At the present time the game of golf is commonly referred to as a "rich man's game" because of the expense attending the formation of a complete course and particularly the putting greens. The golf course ordinarily also includes a plurality of tees from which a ball is driven, a fairway for each hole and some form of a hazard such as a lake or a sand trap.

It happens that a desert setting is particularly adapted for use as a golf course in that the sand or other wasteland material which makes up the fairway ordinarily has formations which are comparable to sand traps and in some instances has surface cavities in which water may be collected in the event of a rainfall and which would provide water hazards. However, ther is no particular part of a desert which is particularly adapted for use as a putting green.

The present invention is founded on the basic concept of providing a mechanical green which eliminates putting and substitutes therefor pitch or chip shots which indicate the accuracy with which such a shot is made with respect to the cup or compartment in which a ball is finally delivered so that a score may be kept which accommodates the drive and approach shots and the accuracy of the final pitch or chip shot which is related to the number of putts which are usually made on a conventional putting green.

Before this application was prepared for filing in the Patent Office, a patentability search was conducted which brings to light certain patents which constitute the prior art which the applicant believes to be the closest to the subject game. These patents are listed as follows:

U.S. Pat. No. 1,656,740—Kurtz
U.S. Pat. No. 3,580,583—Gentiluomo
U.S. Pat. No. 3,856,313—Tierney
U.S. Pat. No. 4,006,907—Heffley
U.S. Pat. No. 2,164,808—Everett
U.S. Pat. No. 2,232,569—Johnson
U.S. Pat. No. 3,275,325—MacKenzie Comment is made on certain of these patents as follows:

Everett:

Everett is believed to be the closest approach to the subject mechanical golf green. The golf green of this patent is designed primarily for practice instruction for the playing of a miniature game, although it is suggested that it is readily adaptable for use as a regular green for a full-sized golf course. However, it is submitted that the putting green device of this patent was neither intended for playing a regular game of golf nor is it adapted to such use. In Everett the green is shown at 10, the driving tee at 11, and a hazard at 13. The mechanism comprises a central compartment 19 and two outer annular compartments defined by circular walls 18 which are concentric with compartment 19. It is important to note that the annular wall defining compartment 19 is formed with two diametrically opposed cups 21 and each of the annular walls 18 with a pair of diametrically opposed cups 16 which are in alignment with the cups in wall 19. Moreover, they are also substantially in alignment with the middle of a driving tee 11. Thus, when a shot is made from the driving tee 11, it is intended that it be received in one of the cups 16 and, due to their aligned spacing, the accuracy of the shot so far as length is concerned is indicated.

However, in the playing of an actual game of golf, the drive or approach shot will often be at one side of the putting cup and it would be extremely difficult, if not impossible, for a player to chip or pitch a ball into one of the cups 16 from the side. Moreover, the return conduits 23 extend from the mechanical green 10 to driving tee 11 as depicted in FIG. 1. It would be literally impossible to play a regular game of golf on a standard course in which a ball after being delivered to a mechanical green is returned to the driving tee. This patent does have some relevancy to the claimed invention in that the sections in receptacle 26 recieve the balls from the return conduit and are marked with numbers indicating the score for each ball as depending on the compartment in which it is received. The fact that this mechanical green is not intended for the playing of a regular game of golf is established in that it refers to the playing by more than one player and the fact that as many as four balls may be received at any one time.

Kurtz:

This patent discloses a golf game apparatus which the patentee suggests may be readily carried in the golf bag. It comprises an inner ring 1 and a larger outer ring 12 which is spaced from the inner ring. Thus the golf ball may be shot into either the compartment defined by the inner ring or the annular compartment between the two rings. There is no provision made for the return of the golf balls or a device for indicating the compartment from which a ball is returned.

Tierney:

This patent discloses a golf putting apparatus with ball return and which has three openings into which a putt is made up an inclined ramp with one hole designated as the making of a "birdie," another is "par" and a third one for a "bogey."

The remaining patents are cited to complete the picture of the prior art which is believed to be in any way relevant to the subject mechanical golf green.

OBJECTS OF THE INVENTION

With the foregoing conditions in mind, the present invention has in view the following objectives:

1. To provide a mechanical golf green which is particularly adapted for installation in a wasteland area such as a desert and which eliminates putting as it is commonly known, with pitch or chip shots being substituted for putting strokes;

2. To provide a mechanical golf green of the type noted which is adapted to be mounted in a mound of sand or similar earth formation;

3. To provide, in a mechanical golf green of the character aforesaid, a compartment assembly comprising a central cup and two annular compartments concentric with the cup and any of which is adapted to receive a ball that is impelled by a pitch or chip shot;

4. To provide, in a mechanical golf green of the kind described, a compartment assembly each compartment of which has an inverted conical bottom having a discharge opening with a ball return conduit connected to each discharge opening;

5. To provide, in a mechanical golf green of the type noted, a receptacle into which balls are returned from the compartments, with the receptacle being divided into sections, there being a section corresponding to each compartment;

6. To provide, in a mechanical golf green of the character aforesaid, a ball return receptacle which is positioned at the periphery of the mound on which the green is installed and into which balls are returned by gravity action;

7. To provide, in a mechanical golf green of the kind described, a return receptacle having a plurality of sections each of which is marked with a numeral which indicates the number of strokes which are to be scored for a ball that is shot into the compartment connected to that section of the receptacle; and 8. To provide, in a mechanical golf green of the type noted, a central cup and three annular walls concentric with the cup, with the upper edges of said cup and walls being arranged at staggered heights, with the edge of the central cup being uppermost.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a mechanical golf green which is installed in a mound of sand or comparable earth material and which comprises a central cylindrical cup, a pair of radially spaced annular walls concentric with the central cup and defining annular compartments, with each of said cups and compartments having an inverted conical bottom formed with a discharge opening.

A receptacle for balls returned from the mechanical green is divided into three sections. A ball return conduit is provided for each section, with one end of each conduit being connected to a section and the other end to one of said discharge openings in the central cup or compartment. Each section of the receptacle is marked with a numeral which indicates the number of strokes which are to be scored when a ball is chipped or pitched into a particular cup or compartment. This receptacle is located at the periphery of the mound on which the mechanical green is installed, and the ball return conduits are canted with respect to the horizontal so that balls roll down the conduits under gravity action.

In a preferred embodiment of the invention, the upper edges of the cup and annular walls lie substantially in the same plane which may be slightly upraised with respect to the upper surface of the mound. In a modified embodiment, these upper surfaces are staggered as to height, with the edge of the wall defining the cup being at the highest level, the edge of the annular wall adjacent to the cup being of a shorter height, and the outermost annular wall lower than the intermediate wall and lying in substantially the plane of the upper surface of the mound. In this embodiment, the central cup and annular compartments have inclined bottoms as compared to conical bottoms, with a ball return conduit being connected to an annular wall immediately adjacent to the lowest point of its inclined bottom.

For a full and more complete understanding of the invention, reference may be had to the following description and accompanying drawing, in which.

DESCRIPTION OF A PREFERRED EMBODIMENT

Figure 1:
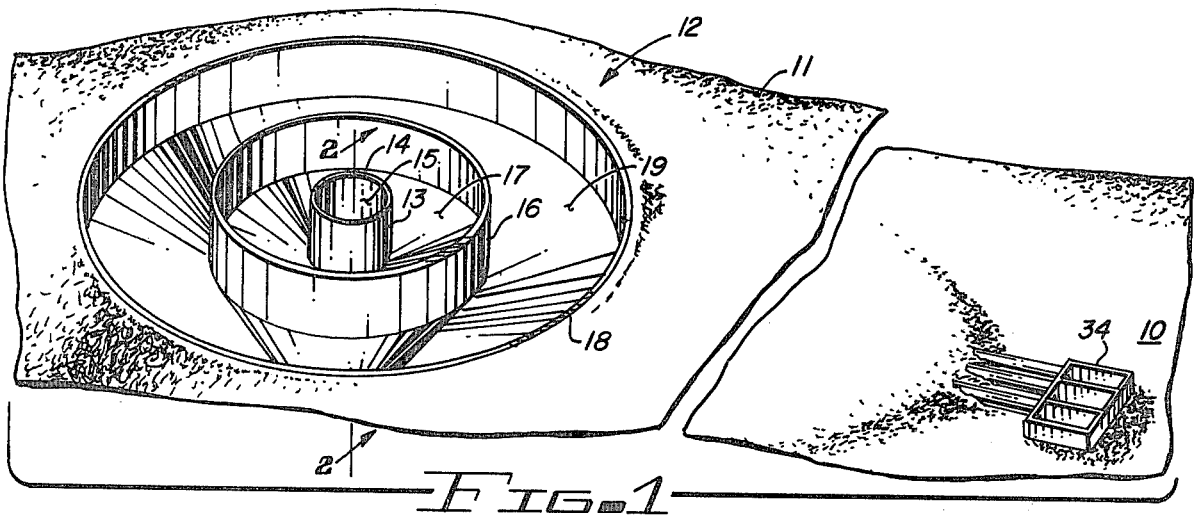
FIG. 1 is a perspective depicting the mechanical golf green of this invention as installed in a mound of soil or comparable wasteland material.

Before referring to the drawings, it is noted that in playing a conventional game of golf a ball is driven from a tee. While it might be possible to drive a ball supported from the desert sand, such a drive would have all the characteristics of an approach shot, and the present invention contemplates the use of a small fabric mat which would be placed on the driving tee area and which could be carried about from hole to hole by the player in his golf bag.

Referring now to the drawing, and first more particularly to FIG. 1, a wasteland formation is indicated at 10, of which a desert is a typical example. A mound 11 is formed on this sand formation in the area which would normally be the site of a putting green. Installed in this mound 11 is a mechanical green which is referred to in its entirety by the reference character 12. In playing a round of golf on a standard course, the present invention will involve a small deviation from the normal routine of golf shots in that conventional putting strokes are obviated. Thus, there is no shot in which a golf ball is rolled over a green into a cup.

A central cylindrical cup 13 has a vertical axis represented by the line 14. It defines a compartment 15 which is intended to receive the ball from a chip or pitch shot which is made with a high degree of accuracy.

Spaced radially from cup 13 is an annular wall 16 which is concentric with axis 14 and cooperates with an annular wall 13 to define an annular compartment 17. For the purposes of this specification, this wall 16 will be identified as an intermediate annular wall. An outer annular wall 18 is also concentric with axis 14 and cooperates with wall 16 to define an annular compartment 19.

When a pitch or chip shot is made, it is intended that it be received in one of the compartments 15, 17 or 19. Thus, these compartments must be of a size which is large compared to a conventional putting cup. Thus, by way of example, compartment 15 would have a diameter of four feet; compartment 17 a diameter of eight feet; and compartment 19 a diameter of twelve feet.

Figure 2:
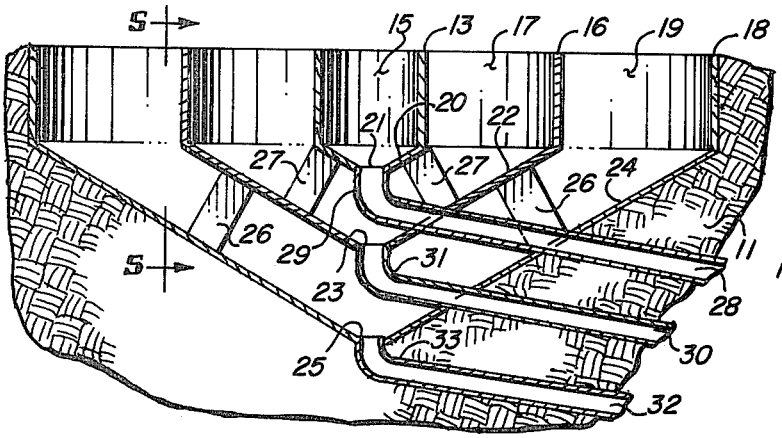
FIG. 2 is a transverse vertical section through the mechanical green and a portion of the mound being taken about on the plane of the line 2—2 of FIG. 1.
Figure 5:
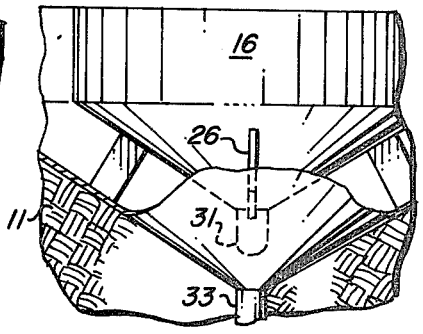
FIG. 5 is a detail vertical section through the outermost compartment, being taken on the line 5—5 of FIG. 2.

Referring now more particularly to FIG. 2, central cup compartment 15 terminates in an inverted conical bottom 20 having a discharge opening or outlet 21. Compartment 17 has an inverted conical bottom 22 formed with a ball discharge outlet 23. Likewise, outer compartment 19 has an inverted conical wall 24 having a discharge outlet 25.

At this point it is well to note that bottom 24 and outer wall 18 are supported by engagement with the sand or material of mound 11. Intermediate wall 16 and bottom wall 22 are supported from bottom 24 by a plurality of angularly spaced supports or brackets 26. Likewise, wall 13 and bottom 20 are supported from wall 22 by angularly spaced brackets 27.

A ball return conduit 28 is embedded in the mound 11 in a position inclined from the horizontal and has an inner upturned end portion 29 which communicates with ball outlet 21. Another ball return conduit 30 is similarly embedded in mound 11 and has an inner upturned end portion 31 which communicates with ball outlet 23, and a third ball return conduit 32 is embedded in mound 11 in an inclined position and has an inner upturned end portion 33 connected to ball outlet 25.

Figure 4:
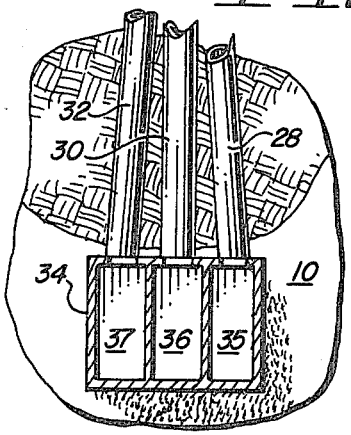
FIG. 4 is a detail horizontal section on an enlarged scale, being taken on the plane of the line 4—4 of FIG. 3.
Figure 3:
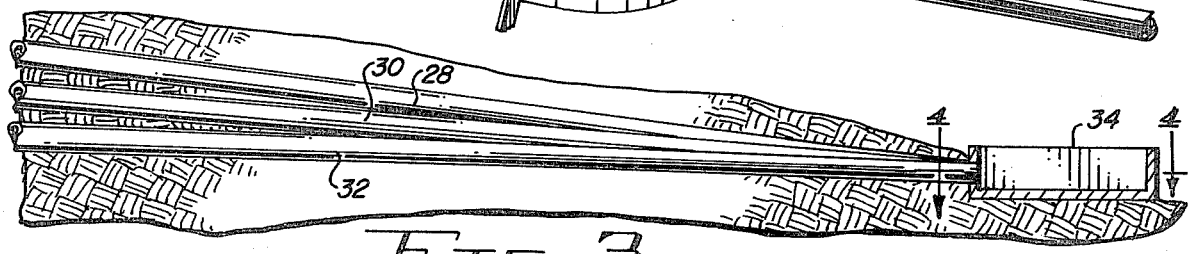
FIG. 3 is a detail vertical section taken on an enlarged scale through a portion of the mound and illustrating the ball return conduits and receptacle in elevation.

Referring now more particularly to FIGS. 3 and 4, a receptacle 34 is divided into three sections 35, 36 and 37. Conduit 28 communicates with section 35; conduit 30 communicates with section 36; and conduit 32 communicates with section 37. The sections 35, 36 and 37 are marked with numerals intended to indicate a score which would correspond to the accuracy with which a putt on a standard green would be made. Thus, section 35 would display the numeral 1, section 36 the number 2, and section 37 the number 3. Thus, if a pitch or chip shot is made with a high degree of accuracy, it would be received in the compartment 15 of central cup 13 and, after it is returned to the compartment 34, it would be received in section 35 thereof and thus indicate that one stroke had been made on the green which would correspond to a "birdie." Likewise, if the ball should land in compartment 17 it would be returned to section 36, which indicates that two strokes are scored as corresponding to two putts on a standard green. Finally, a pitch or chip shot which ends up in compartment 19 would return the ball to section 37, which is equivalent of three standard putts, or a "bogey" for the hole. Needless to say, the golf ball will fall down into any of the compartments to the inverted conical bottom out of the discharge outlet and then roll down the ball return conduit for that particular compartment to one of the sections of receptacle 34.

THE MODIFICATION

Figure 6:
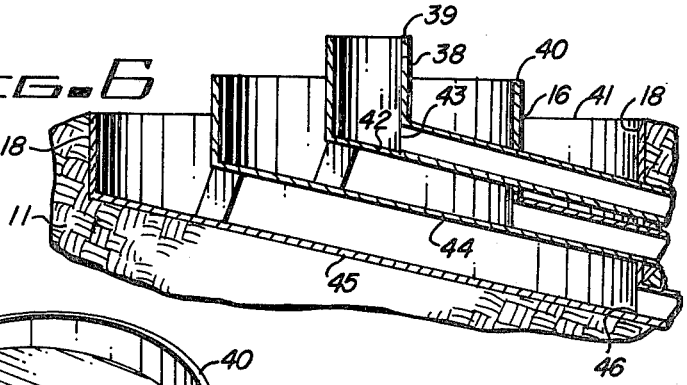
FIG. 6 is a detail vertical section through a portion of a modified embodiment.

In the preferred embodiment of FIGS. 1-5, inclusive, the upper edges of the walls 13, 16 and 18 lie in substantially the same horizontal plane which may be slightly upraised with respect to the upper surface of mound 11. In the modified embodiment of FIGS. 6 and 7, a central cylindrical wall 38 has an upper edge 39, while intermediate annular wall 16 has an upper edge 40 which is lower than edge 39 and outer annular wall 18 has an upper edge 41 which is lower than edge 40 and is substantially flush with mound 11 as indicated in FIG. 6.

Figure 7:
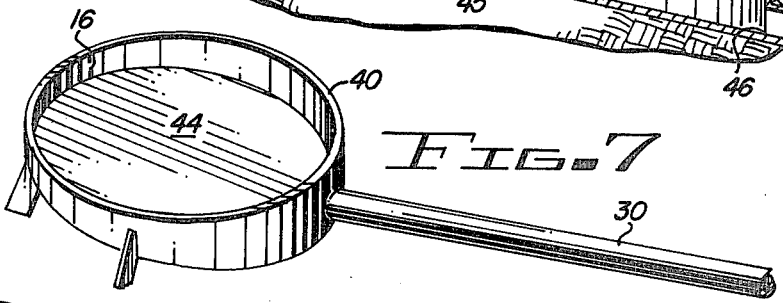
FIG. 7 is a detail perspective of the central cup and ball return conduit connected thereto.

In the embodiment of FIGS. 1-5, inclusive, the bottom of each compartment is defined by an inverted conical wall. In the modification of FIGS. 6 and 7, annular wall 38 terminates at an inclined bottom 42. It is also formed with a ball outlet at 43 immediately adjacent to the lowermost point of inclined bottom 42. Ball return conduit 28 is connected to wall 38 at this outlet 43. In a similar manner, intermediate wall 16 terminates in an inclined bottom 44 having a discharge outlet to which ball return conduit 30 is connected. Likewise, outer wall 18 terminates in an inclined bottom 45 with discharge conduit 32 being connected to a ball outlet at the lowermost point of inclined bottom 45, as indicated at 46. The remainder of the structure of the modification of FIGS. 6 and 7 is substantially the same as that illustrated in FIGS. 1-5, inclusive. Moreover, the operation of the modified mechanical green is substantially the same as that above described in connection with FIGS. 1-5, inclusive.

While a preferred specific embodiment of the invention is hereinbefore set forth, it is to be clearly understood that the invention is not to be limited to the exact construction, materials and devices illustrated and described because various modifications of these details may be provided in putting the invention into practice.

What is claimed is:

1. In a mechanical golf green, a raised mound of an earth formation having a periphery and an upper surface:

(a) an outer annular wall having an upper edge which is substantially flush with the upper surface of the mound when the mechanical green is installed therein;

(b) an intermediate annular wall spaced from, concentric with, and supported from said outer annular wall and cooperating therewith to define an outer annular compartment;

(c) an inner cylindrical cup supported from said intermediate annular wall having an axis concentric with said intermediate annular wall and cooperating therewith to define an intermediate annular compartment, said cylindrical cup also defining a ball-receiving compartment;

(d) each of said compartments having an inverted conical bottom formed with a ball discharge outlet;

(e) a ball return conduit communicating with the ball discharge outlet of each of said compartments, said conduits being embedded in said mound and inclined with respect to the horizontal and presenting a lower ball discharge end portion; and (f) a ball return receptacle located at the periphery of said mound and having three sections each of which is connected to the ball discharge end portion of a ball return conduit and bearing indicia for representing a score that is comparable to the number of putting strokes on a conventional putting green.

2. The mechanical golf green of claim 1 in which each of said ball return conduits has an upper vertical end portion connected to a conical wall at the ball discharge outlet therein.

3. The mechanical golf green of claim 1 in which each of said annular walls has an upper edge with all said upper edges in substantially the same horizontal plane.

4. The mechanical golf green of claim 3 in which said plane is slightly upraised with respect to the upper surface of said mound.

5. The mechanical golf green of claim 1 in which said intermediate wall is supported from the bottom wall of said outermost compartment by a plurality of angularly spaced brackets and said central cylindrical wall is supported from the bottom wall of said intermediate compartment by a plurality of angularly spaced brackets.

6. In a mechanical golf green, a raised mound of an earth formation having a periphery and an upper surface:

(a) an outer annular wall having an upper edge which is substantially flush with the upper surface of the mound when the mechanical green is installed therein;

(b) an intermediate annular wall spaced from, concentric with, and supported from said outer annular wall and cooperating therewith to define an outer annular compartment;

(c) an inner cylindrical cup supported from said intermediate annular wall having an axis concentric with said intermediate annular wall and cooperating therewith to define an intermediate annular compartment, said cylindrical cup also defining a ball-receiving compartment;

(d) each of said compartments having an inclined bottom presenting a lowermost point, together with a ball discharge outlet at said lowermost point;

(e) a ball return conduit communicating with the ball discharge outlet of each of said compartments, said conduits being embedded in said mound and inclined with respect to the horizontal and presenting a lower ball discharge end portion; and (f) a ball return receptacle located at the periphery of said mound and having three sections each of which is connected to the ball discharge end portion of a ball return conduit and bearing indicia for representing a score that is comparable to the number of putting strokes on a conventional putting green.

7. The mechanical golf green of claim 6 in which each of said annular walls has an upper edge, with said upper edges being staggered in height and the upper edge of the central cylindrical wall being at the highest level.

* * * * *